US007542705B2

(12) United States Patent
Tsunemi et al.

(10) Patent No.: US 7,542,705 B2
(45) Date of Patent: Jun. 2, 2009

(54) ELECTROPHOTOGRAPHIC IMAGE FORMING APPARATUS INCLUDING A DEVELOPING ROLLER FOR A DEVELOPING UNIT USING NON-MAGNETIC MONO-COMPONENT TONER, AND DEVELOPING METHOD USING THE SAME

(75) Inventors: Koichi Tsunemi, Suwon-si (KR); Jun-Ho Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 389 days.

(21) Appl. No.: 11/369,750

(22) Filed: Mar. 8, 2006

(65) Prior Publication Data

US 2006/0257174 A1 Nov. 16, 2006

(30) Foreign Application Priority Data

May 16, 2005 (KR) ..... 10-2005-0040562

(51) Int. Cl.
*G03G 15/08* (2006.01)

(52) U.S. Cl. ..... 399/284

(58) Field of Classification Search ..... 399/279, 399/284–286

See application file for complete search history.

(56) References Cited

U.S. PATENT DOCUMENTS

2002/0191990 A1* 12/2002 Hirano et al. ..... 399/279
2003/0095814 A1* 5/2003 Miyakawa et al. ..... 399/252
2003/0175055 A1* 9/2003 Machida et al. ..... 399/285
2004/0234881 A1 11/2004 Miyakawa et al.
2005/0163538 A1* 7/2005 Yamamura ..... 399/279

FOREIGN PATENT DOCUMENTS

| | | |
|---|---|---|
| JP | 07-199523 | 8/1995 |
| JP | 2000-003063 | 1/2000 |
| JP | 2000-047427 | 2/2000 |
| JP | 2002-023425 | 1/2002 |
| JP | 2002-244336 | 8/2002 |
| JP | 2004-0101958 | 4/2004 |
| JP | 2004-0279916 | 10/2004 |
| KR | 1999-0015301 | 3/2001 |
| KR | 1020030060383 | 7/2003 |
| KR | 1020030080935 | 10/2003 |
| KR | 1020050011397 | 1/2005 |

* cited by examiner

*Primary Examiner*—David M Gray
*Assistant Examiner*—Joseph S. Wong
(74) *Attorney, Agent, or Firm*—Roylance, Abrams, Berdo & Goodman, LLP

(57) ABSTRACT

An electrophotographic image forming apparatus is provided which includes an image receptor on which an electrostatic latent image is formed. A developing unit develops the electrostatic latent image by supplying non-magnetic mono-component toner to the electrostatic latent image and includes a developing roller which faces the image receptor. A trail type regulating blade is installed to form a uniform toner layer on the developing roller. In the electrophotographic image forming apparatus, the rate of the amount of toner particles having a diameter of not more than about half of a median value of a volume-diameter distribution of the toner is not more than about 15% in a number-diameter distribution.

11 Claims, 4 Drawing Sheets

ELECTROPHOTOGRAPHIC IMAGE FORMING APPARATUS INCLUDING A DEVELOPING ROLLER FOR A DEVELOPING UNIT USING NON-MAGNETIC MONO-COMPONENT TONER, AND DEVELOPING METHOD USING THE SAME

CROSS-REFERENCE TO RELATED PATENT APPLICATIONS

This application claims the benefit under 35 U.S.C. § 119(a) of Korean Patent Application No. 10-2005-0040562, filed on May 16, 2005, in the Korean Intellectual Property Office, the entire disclosure of which is incorporated hereby by reference.

BACKGROUND OF THE INVENTION

1. Field of the Invention

The present invention relates to an electrophotographic image forming apparatus. More particularly, the present invention relates to an electrophotographic image forming apparatus including a developing roller which uses a non-magnetic mono-component toner and a developing method using the same.

2. Description of the Related Art

An electrophotographic image forming apparatus using non-magnetic mono-component toner includes a regulating blade for regulating the thickness of a toner layer formed on a developing roller. The regulating blade can be divided into a variety of types according to the installation direction of the regulating blade. For example, the regulating blade can be installed such that the direction of the leading end portion of the regulating blade is the same as a direction opposite to the rotational direction of a developing roller. This is typically referred to as a counter type or leading type regulation blade. This type of regulating blade helps to maintain a uniform toner layer on the developing roller. However, the regulating blade is disadvantageous in that minimizing the size of the developing unit is relatively difficult. In another type of regulating blade, namely the trail type regulating blade, the leading end portion of the regulating blade is installed in the same direction as the rotational direction of the developing roller. This type of regulating blade is advantageous in minimizing the size of the developing unit. However, the regulating blade requires a greater contact force with the developing roller because the regulating blade can be pushed by the toner. Thus, a toner filming phenomenon can be generate due to higher contact forces. Also, the life span of the developing unit may be reduced.

Accordingly, there is a need for an electrophotographic image forming apparatus adopting a trail type regulating blade which enables reduction in the size of the apparatus and an improved life span of the developing unit.

SUMMARY OF THE INVENTION

An aspect of the present invention is to address at least the above problems and/or disadvantages and to provide at least the advantages described below. Accordingly, an aspect of the present invention is to provide an electrophotographic image forming apparatus adopting a trail type regulating blade which enables a long life span for the developing unit and a smaller sized developing unit.

Exemplary embodiments of the present invention provide a development method which enables the reliable printing of high quality images.

Exemplary embodiments of the present invention also provide a developing roller which enables the reliable print of a high quality image.

According to an aspect of the present invention, an electrophotographic image forming apparatus is provided comprising an image receptor on which an electrostatic latent image is formed. A developing unit develops the electrostatic latent image by supplying non-magnetic mono-component toner to the electrostatic latent image and includes a developing roller facing the image receptor. A trail type regulating blade is installed to form a uniform toner layer on the developing roller. The rate of amount of toner particles having a diameter of not more than about half of a median value of a volume-diameter distribution of the toner is not more than about 15% in a number-diameter distribution.

The developing unit comprises a development cartridge including the developing roller and the regulating blade. A toner cartridge containing toner is supplied to the development cartridge.

The toner is supplied from the toner cartridge to the development cartridge before the residual quantity of toner in the development cartridge reaches not more than about 1 percent of the weight of the maximum charge amount.

An elastic rubber layer having a thickness of not less than about 0.5 mm and not more than about 60% of the radius of the developing roller and a resistance between about $10^5$-$10^{11}$ Ω/cm is provided on a surface of the developing roller.

The developing roller separates from the image receptor a distance as wide as a development gap.

According to another aspect of the present invention, a developing method using non-magnetic mono-component toner comprises the step of supplying non-magnetic mono-component toner in which the rate of the amount of toner particles having a diameter of not more than about half of a median value of a volume-diameter distribution is not more than about 15% in a number-diameter distribution to a developing roller. The method also comprises the step of forming a uniform toner layer on the developing roller using a trail type regulating blade and applying a development bias to the developing roller to develop an electrostatic latent image formed on an image receptor using the toner of the toner layer.

The toner is supplied from a toner cartridge to a development cartridge before the residual quantity of toner in the development cartridge reaches not more than about 1 percent of the weight of the maximum charge amount.

According to another aspect of the present invention, a developing roller for a developing unit using non-magnetic mono-component toner, wherein an elastic rubber layer having a thickness of not less than about 0.5 mm and not more than about 60% of the radius of the developing roller and a resistance between $10^5$-$10^{11}$ Ω/cm is provided on a surface of the developing roller.

The surface roughness Rz of the developing roller is about 1/10 through about 5 times greater than a median value of a volume-diameter distribution.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, and features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
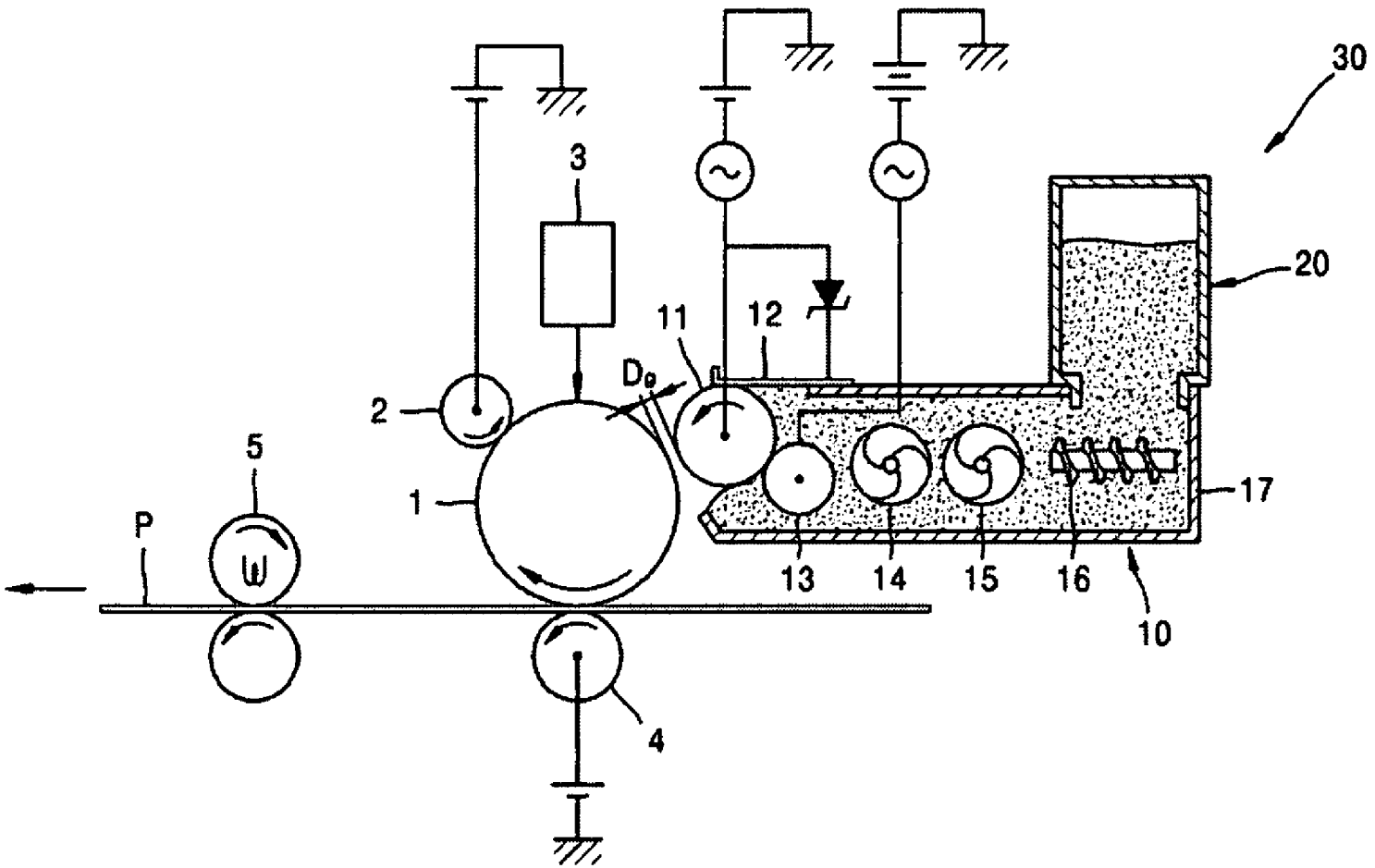
FIG. 1 illustrates the construction of an electrophotographic image forming apparatus according to an exemplary embodiment of the present invention.

Referring to FIG. 1, an electrophotographic image forming apparatus includes an image receptor 1, a charger 2, an exposure unit 3, a developing unit 30, a transfer unit 4, and a fuser 5. A photosensitive medium such as a photosensitive drum or photoreceptor web, or an electrostatic drum (or electrostatic belt) is used as the image receptor 1. In the present embodiment, a photosensitive drum is used as the image receptor 1. The charger 2 charges the surface of the image receptor 1 to a uniform electric potential. In the present embodiment, a charge roller for applying a charge bias voltage is used as the charger 2; however, a corona discharger 2 can be used therefor. The exposure unit 3 scans light corresponding to image information onto the surface of the image receptor 1 to form an electrostatic latent image. A laser scanning unit (LSU) using a laser diode as a light source is mainly used as the exposure unit 3. When the electrostatic drum (or electrostatic belt) is used as the image receptor 1, an electrostatic recording head is adopted instead of the exposure unit 3. The developing unit 30 supplies toner to the electrostatic latent image to develop the electrostatic latent image to a visual toner image. The toner image is transferred to a recording medium P by a transfer bias applied to the transfer unit 4 and the transferred image is fused and fixed on the recording paper P.

The developing unit 30 includes a developing roller 11 and the regulating blade 12. The developing unit 30 may further include a supply roller 13 for attaching toner to the developing roller 11 and agitators 14 and 15 for transferring the toner toward the supply roller 13. According to the present exemplary embodiment which adopts a non-contact development method, the surface of the developing roller 11 separates from the surface of the image receptor 1 a distance as wide as a development gap. The length of a development gap Dg is several ten to several hundred microns. The regulating blade 12 contacts the surface of the developing roller 11 and regulates the thickness of the toner layer adhering to the surface of the developing roller 11 so as to be uniform. A development bias allows the toner to move to the electrostatic latent image of the image receptor 1 and is applied to the developing roller 11. Also, a bias for allowing the toner to adhere to the developing roller 11 is applied to the supply roller 13.

Figure 2:
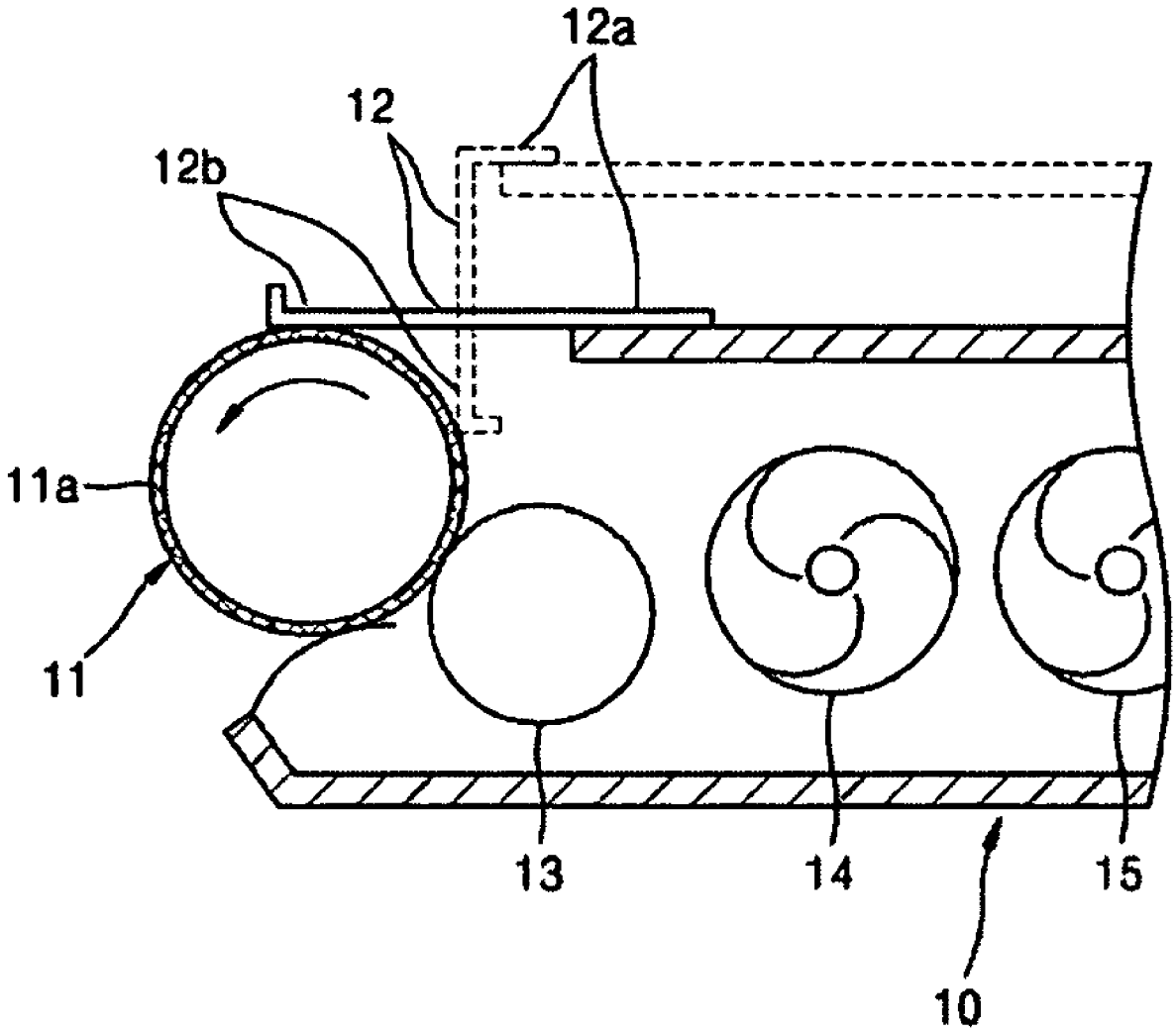
FIG. 2 is a detailed view of the developing unit.

The regulating blade 12 may be manufactured of an elastic material having a thin plate shape such as a stainless steel plate or phosphor bronze plate. As shown in FIG. 2, the regulating blade 12 includes a fixed portion 12*a* fixed to a housing 17 and an elastic portion 12*b* elastically contacting the outer circumference of the developing roller 11. The method of installation of the regulating blade 12 includes a trail method and a counter method. In the present exemplary embodiment, the regulating blade 12 is installed to contact the developing roller 11 in the trail method. In the trail method, the regulating blade 12 is installed such that the direction from the fixed portion 12*a* toward the elastic portion 12*b* is the same as the direction of rotation of the developing roller 11. That is the direction in which the outer circumferential surface of the developing roller 11 proceeds. According to the counter method shown by a dotted line in FIG. 2, the regulating blade 12 is installed such that the direction from the fixed portion 12*a* toward the elastic portion 12*b* is opposite to the direction in which the outer circumferential surface of the developing roller 11 proceeds. In order for the regulating blade 12 to perform a function of frictionally charging the toner and regulate the amount of toner, a predetermined length (a free length) from the fixed portion 12*a* to the elastic portion 12*b* should be constant. Thus, when the regulating blade 12 is installed in the counter method, the overall volume of the developing unit 30 is increased to secure the free length. Therefore, the trail method adopted in the present exemplary embodiment is advantageous in minimizing the size of the developing unit 30. However, in the case of the trail method, since the toner adhering to the developing roller 11 pushes the regulating blade 12 as the developing roller 11 rotates, the regulating blade 12 is likely to be pushed upward. Thus, there is a need for increasing a contact force of the regulating blade 12 with respect to the developing roller 11 greater than that in the counter method, to prevent the regulating blade 12 from being pushed.

The toner used for the electrophotographic image forming apparatus according to exemplary embodiments of the present invention is a non-magnetic mono-component toner (hereinafter, referred to as the toner). The toner is manufactured using raw materials of resin, pigment, wax and a charge control agent (CCA). The raw materials are mixed into a powder state and heated, resolved, and mixed by a kneader. The kneader includes a twin screw extruder, an open roller type kneader, and a batch type kneader. The resolved and mixed toner is quickly cooled by a cooling belt or cooling roller and is solidified. The solidified toner is first roughly crushed. The rough crusher typically crushes the solidified toner to, but not limited to, an average diameter of about 300 μm. Also, the solidified toner can be crushed to a diameter of about 30 μm by using a high performance rough crusher. Furthermore, it is preferable that the diameter of a particle in the rough crush process is as small as possible to the minimum diameter of about 15 μm. Next, the roughly crushed powder undergoes a fine crush process and a classification process to obtain a predetermined diameter.

In the electrophotographic image forming apparatus using non-magnetic mono-component toner, since toner having a diameter that is easy to develop tends to be selectively developed during a development process, it is relatively important that the distribution of the diameter of toner needs to be appropriately controlled. Also, for the toner having a smaller diameter, in particular, a toner particle having a diameter that is not more than about half (½Dv50) of a median value (Dv50) of the volume diameter distribution, the content of wax tends is greater than the amount of wax input as a raw material during a manufacturing process. This is confirmed from the measurement of an endothermic peak using a differential scanning calorimeter (DSC). For example, there are many cases in which the wax content of 2.0% tends to increase to 2.2% or more for toner particles having a diameter of not more than about ½Dv50. The toner having a small diameter and a high wax content is not suitable for the image forming apparatus adopting the trail method. This is because, in the image forming apparatus adopting the trail method, the toner layer on the surface of the developing roller 11 pushes up the regulating blade 12 as the developing roller 11 rotates so that a contact force of the regulating blade 12 to the developing roller 11 must be sufficiently large. Due to this great contact force, the toner is pressed against the regulating blade 12 and adheres thereto. Since the toner becomes softer as the wax content increases, the toner more easily adheres to the regulating blade 12 so that a film is generated. When the film is generated, a linear line is generated on the toner layer of the developing roller 11 and the line appears on a developed image. When the film is continually generated on the regulating blade 12 continues, a film is also generated on the surface of the developing roller 11. Since the toner having a small diameter has a low charge amount, development is not well performed. Also, the toner having a small diameter is easily scattered, thus contaminating the image forming apparatus. Thus, it is very important to appropriately adjust the diameter distribution of the toner. Data illustrates that the toner affecting the filming and scattering of toner typically has a diameter that is not more than the about half (½Dv50) of the median value (Dv50).

The diameter distribution is typically measured by Coulter Multisizer Type II or Type III (Coulter Corp.). The measurement of the diameter distribution of toner includes a volume-diameter distribution and a number-diameter distribution. Typically, the average diameter of toner indicates the median value (Dv50) of the volume-diameter distribution. However, the toner particles having a diameter less than the average diameter have a low volume fraction but are relatively large in number. Since the toner negatively affecting the development is the toner having a diameter less than the average diameter, the fraction of the toner having a diameter less than the average diameter needs to be controlled using a number fraction rather than a volume fraction.

Figure 3:
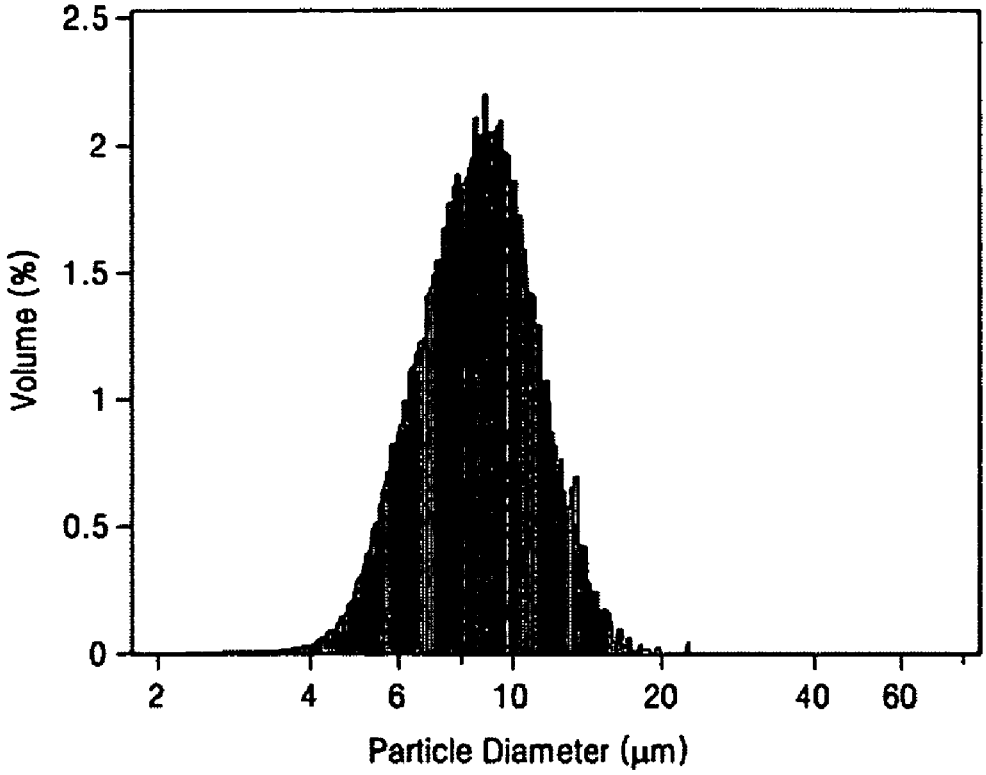
FIG. 3 is a graph showing an example of the relationship between the volume and particle diameter of toner.
Figure 4:
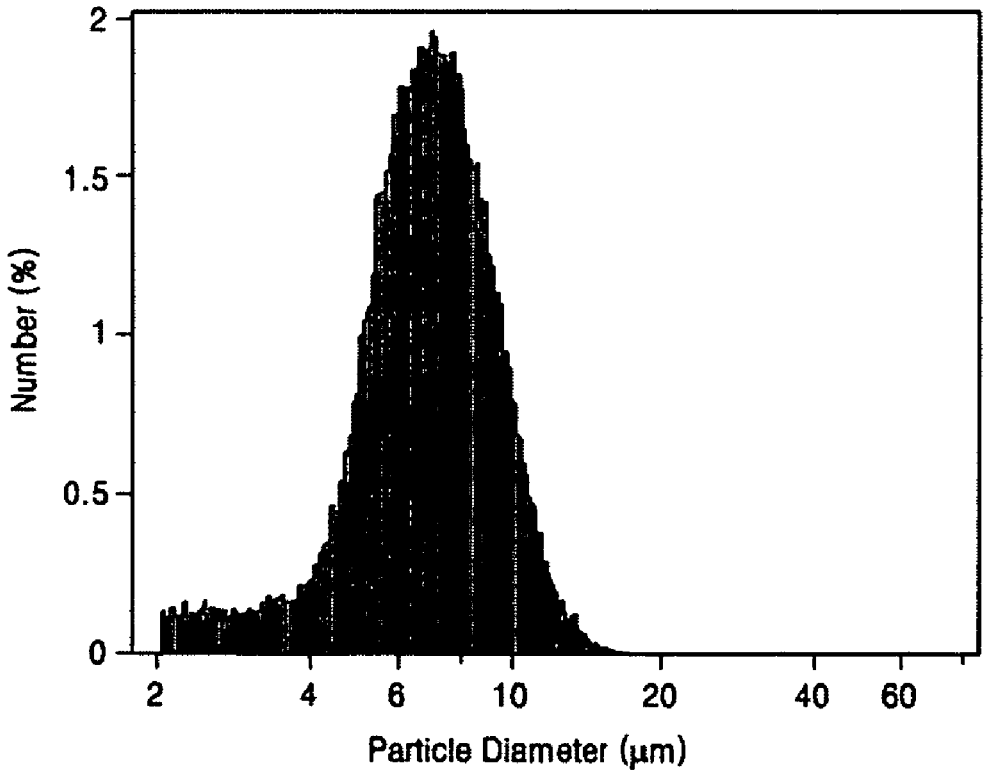
FIG. 4 is a graph showing an example of the relationship between the number and particle diameter of toner.

FIGS. 3 and 4 are graphs showing the volume-diameter distribution and number-diameter distribution of toner, respectively. Referring to FIGS. 3 and 4, the median value (Dv50) of the volume-diameter distribution and the median value (Dp50) of the number-diameter distribution are 8.520 and 6.702, respectively, are illustrated so that Dp50 is less than Dv50. Although it may vary according to the sharpness of the diameter distribution, Dv50 is generally greater than Dp50 by 10 to 40%. Since the half (½Dp50) of the median value (Dp50) of the number-diameter distribution is smaller than the half (½Dv50) of the median value (Dv50) of the volume-diameter distribution, the diameter of toner negatively affecting the development is not accurately presented by ½Dp50. This can be relatively easily determined by referring to the number of particles whose diameter is less than 4.26 μm (½Dp50). That is, although the volume rate of toner having a diameter of not more than 4 μm is merely about 0.49%, the number rate is about 6.81%. Also, although the volume rate of toner having a diameter of not more than 5 μm is merely about 2.58%, the number rate is about 15.8%. The data illustrates that a superior development performance can be obtained by using ½Dv50 as a representative value of the diameter of the toner negatively affecting the development and controlling the rate of the toner particles having a diameter of not more than ½Dv50 in the number-diameter distribution to be 15% or less. According to these standards, for example, since ½Dv50 is 4.0 μm when Dv50 is 8.0 μm, the rate of toner having a diameter of not more than 4.0 μm in the number-diameter distribution needs to be controlled to be 15% or less.

To achieve the above-described toner diameter distribution, the crushed toner needs to be classified after crushing and the polymerization of the toner usually does not need classification, but is classified after polymerization and drying, if necessary. A classifier such as a wind force classifier, a classifier using a Koander effect, and a mechanical classifier for classifying toner by rotating a rotor at a high speed is used. However, any classifier capable of obtaining the diameter distribution according to exemplary embodiments of the present invention can be used therefor.

When toner having Dv50 that is not more than 7 μm is manufactured, it is better to use the following crush method. A raw material is cooled after being resolved and mixed, and then roughly crushed by a pin mill. The roughly crushed material is crushed halfway by a mechanical crusher which crushes a material to be crushed by passing between a rotor rotating at a high speed and a stator fixed therearound. Accordingly, the Dv50 is 10-400 μm, preferably, 15-50 μm. When Dv50 of the halfway crushed toner is too small, it is difficult to adjust the optimal diameter distribution in the subsequent fine crush process. Also, when Dv50 is to large, the halfway crush process is not affective.

In the fine crush process, a jet type mill or mechanical type mill can be used. It is preferable to simultaneously perform a process of classifying and removing fine powder having a diameter of not more than 2-3 μm. In the process, Dv50 is set to 7.5-10 μm. A fine powder classification process is advantageous in improving an efficiency of an ultra fine crush process and simultaneously reducing energy load. That is, classified powder that is 30-70% larger than Dv50 that will be a final target in the ultra fine crush process is manufactured in a fine crushing and classification process after the mid-crush process. The 30-70% large fine powder is manufactured in the fine crush process and simultaneously fine powder having a diameter of not more than 2-3 μm which is difficult to be classified in the ultra fine crush process is classified and removed in advance. By doing so, in the final ultra fine crush process, toner having a diameter of not more than 6 μm can be manufactured with energy that shows no significant difference from one for manufacturing typical toner having a diameter of not less than 7 μm. Also, since the fine powder having a diameter of 2-3 μm is classified and removed in a state in which Dv50 is still large, that is, 30-70% larger than the final target, yield in the ultra fine crush process can be increased. Further, toner in which the rate of toner having a diameter less than ½Dv50 is not more than 15% in the number-diameter distribution can be sufficiently manufactured.

An elastic rubber layer 11*a* is provided on the surface of the developing roller 11. The thickness of the elastic rubber layer 11*a* is not less than 0.5 mm and not more than 60% of the radius of the developing roller 11. A bias voltage needs to be applied to the developing roller 11 to sufficiently charge toner. To allow the bias voltage to effectively act in charging the toner, the resistance of the elastic rubber layer 11*a* is optimally between $10^5$-$10^{11}$ Ω/cm. When the resistance is too low, current leakage is generated so that a sufficient electric field is not provided to the toner. When the resistance is too high, electric charges are not sufficiently provided to the toner, which deteriorates the development.

The resistance is measured as follows. A metal electrode having a length between, for example, 100-200 mm contacts the surface of the developing roller 11 and a particular DC voltage, for example, 500-1000 V, is applied. Current is measured and divided by resistance. This value is divided again by the length of the metal electrode to obtain the resistance of the developing roller 11. When the DC voltage is applied, the current decreases with the passage of time. Thus, current after a particular time, for example, 10, 30, or 60 seconds after the voltage is applied, is used.

The surface roughness Rz of the elastic rubber layer 11*a* greatly affects toner charge amount or performance of transferring toner to the development gap Dg. When the surface roughness Rz is too large, a uniform toner layer cannot be formed and the uniformity of an image is damaged. When the surface roughness Rz is too small, the toner charge amount cannot be sufficiently obtained. Considering the above, it is very appropriate that the surface roughness Rz is within a range of 1/10 through 5 times of Dv50.

For an image forming apparatus using a two-component toner, when the toner contained in the developing unit 30 is consumed, only the toner is generally replaced and the developing unit 30 is reused. For the image forming apparatus using a mono-component toner, the developing unit 30 includes a chamber (not shown) where toner is contained. In this case, the life span of the developing unit is dependent on the amount of the toner contained therein and, when the toner is completely consumed, the developing unit 30 itself is replaced. The toner is typically contained in the developing unit 30 and is configured to print about several thousand pages. When the toner is totally consumed, the developing unit 30 itself is replaced. This is because the developing roller 11 and the regulating blade 12 are contaminated due to the film generated. Accordingly, a high quality image cannot be stably obtained for a long time with a method of refilling only additional toner. However, according to the image forming apparatus according to the present embodiment using the toner in which the content of toner having a diameter of not more than ½Dp50 is not more than 15% in the number-diameter distribution, the conventional life span of the developing roller 11 and the regulating blade 12 equivalent to print of 5,000-10,000 pages (A4 size) can be increased to 30,000 pages or more. Thus, the amount of toner capable of printing 30,000 pages or more can be contained in the developing unit 30 so that the cost for expendable supplies can be reduced.

The amount of toner consumed for printing with a 5% coverage is about 15-20 mg/print so that the amount of toner for printing 30,000 pages reaches 450-900 g. To accommodate this amount of toner, the size of the developing unit 30 needs to be greatly increased, which is disadvantageous in minimizing the size of the image forming apparatus. In particular, a color image forming apparatus generally requires four developing units 30 for containing cyan, magenta, yellow, black toners becomes relatively large in size. For the distribution of color image forming apparatuses to homes to include SOHO, the minimization of the color image forming apparatus is preferred.

As shown in FIG. 1, the developing unit 30 according to the present embodiment includes a development cartridge 10 and a toner cartridge 20. The toner cartridge 20 is detachably installed on the development cartridge 10. The toner cartridge 20 contains toner equivalent to the amount capable of printing, for example, several thousand pages. This structure enables the minimization of the developing unit 30 and the image forming apparatus. The toner contained in the toner cartridge 20 is supplied to the development cartridge 10 by the weight of the toner itself or a transfer unit (not shown). When the toner in the toner cartridge 20 is completely consumed, only the toner cartridge 20 needs replacement. Since the toner cartridge 20 can be manufactured at a very low cost, because the toner cartridge 20 needs to contain the toner only, the cost for expendable supplies can be drastically reduced.

When no toner is left in the development cartridge 10 and the developing roller 11 rotates, the toner does not serve as a lubricant between the developing roller 11 and the regulating blade 12 so that the developing roller 11 and the regulating blade 12 rub excessively with each other. Then, toner filming is generated on the regulating blade 12 and the developing roller 11 within a relatively short time, for example, 1-2 hours, or the developing roller 11 is damaged. According to exemplary embodiments of the present invention, the above problem can be addressed by supplying toner to the development cartridge 10 by operating, for example, a toner supply auger 16, before the residual quantity of toner in the development cartridge 10 reaches not more than 1 weight percent of the maximum toner capability of the development cartridge 10. The image forming apparatus can detect the residual quantity of toner by emitting light onto an inner wall surface of the housing 17 of the development cartridge 10 and measuring a reflection rate of the light. Also, the residual quantity of toner can be detected by emitting light to a transmission plate (not shown) installed in the housing 17 from the outside of the housing 17 and measuring the quantity of the light that transmits the transmission plate. Also, the residual quantity of toner can be detected by counting the number of printed pixels. The maximum toner capability of the development cartridge 10 can be obtained by multiplying an effective volume of the development cartridge 10 (a volume for charging toner except for the volume for the supply roller 13, the developing roller 11, and the agitators 14 and 15) by the apparent density (AD) of toner. The AD can be easily measured using a powder tester made by Hosokawa Micro Corp. The AD of the toner used in the present invention is 0.3-0.45 g/cm$^3$.

Figure 5:
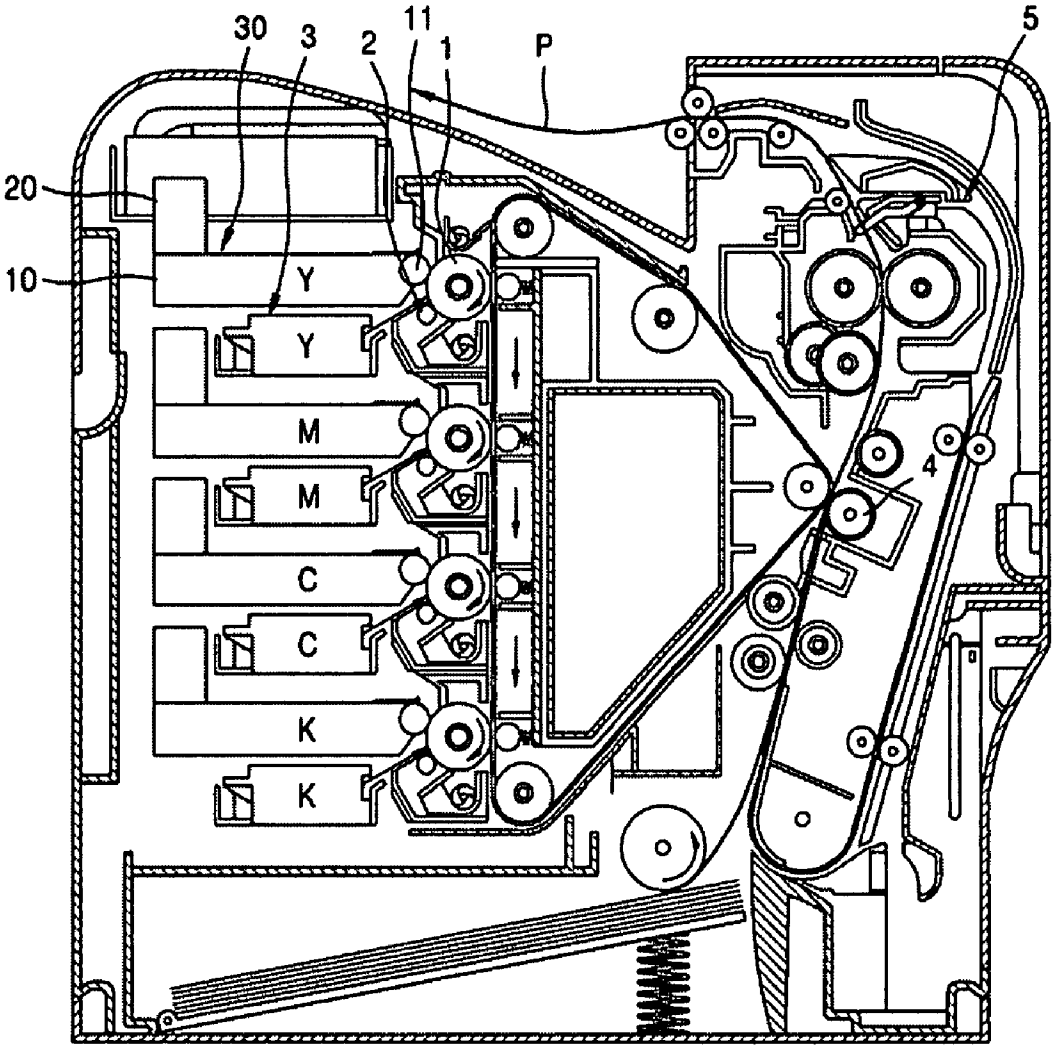
FIG. 5 illustrates the construction of a tandem type color image forming apparatus.

The regulating blade 12 is installed in a trail method. The diameter of the developing roller 11 is 15 mm and the thickness of the elastic rubber layer 11*a* is 1.0 mm. The resistance of the developing roller 11 is $10^9$ Ω/cm and the surface roughness Rz is 8 μm. Yellow (Y), cyan (C), magenta (M), and black (K) toners having Dv50 of 8.0 μm are manufactured. The rate of in the number-diameter distribution of toner particles having a diameter of not more than ½Dv50 (4 μm) of the above toners is 12% The above-described conditions are applied to a tandem type (single path type) color image forming apparatus having four exposure units 3 and the developing unit 30, as shown in FIG. 5. The effective internal volume of each of the developing unit 30 is 120 cm$^3$, the AD of toner is 0.34 g/cm$^3$ for Y toner, 0.37 g/cm$^3$ for M toner, 0.33 g/cm$^3$ for C toner, and 0.39 g/cm$^3$ for K toner. A reliability test was performed by performing print with a 5% coverage. The residual quantity of toner in the development cartridge 10 is calculated by counting the number of exposed dots of the exposure unit 3 that is equivalent to the number of pixels. When the residual quantity of toner in the development cartridge 10 reaches 8%, the toner is supplied. According to the present test, over 40,000 pages of high quality images can be continuously printed.

The regulating blade 12 is installed in a trail method. The diameter of the developing roller 11 is 15 mm and the thickness of the elastic rubber layer 11*a* is 1.0 mm. The resistance of the developing roller 11 is $10^9$ Ω/cm and the surface roughness Rz is 8 μm. Yellow (Y), cyan (C), magenta (M), and black (K) toners having Dv50 of 8.0 μm are manufactured. The rate in the number-diameter distribution of toner particles having a diameter of not more than ½Dv50 (4 μm) of the above toners is 23%. The above-described conditions are applied to a tandem type (single path type) color image forming apparatus having four exposure units 3 and the developing unit 30 as shown in FIG. 5. The effective internal volume of each of the developing unit 30 is 120 $cm^3$, the AD of toner is 0.34 $g/cm^3$ for Y toner, 0.37 $g/cm^3$ for M toner, 0.33 $g/cm^3$ for C toner, and 0.39 $g/cm^3$ for K toner. A reliability test was performed by performing print with a 5% coverage. The residual quantity of toner in the development cartridge 10 is calculated by counting the number of exposed dots of the exposure unit 3 that is equivalent to the number of pixels. When the residual quantity of toner in the development cartridge 10 reaches 8%, the toner is supplied. According to the present test, although a relatively high quality image can be obtained at the initial stage, toner filming is generated at the regulating blade 12 before printing 3,000 pages so that the concentration of an image is deteriorated and a vertical line pattern is generated on a printed image.

The regulating blade 12 is installed in a trail method. The diameter of the developing roller 11 is 15 mm and the thickness of the elastic rubber layer 11*a* is 1.0 mm. The resistance of the developing roller 11 is $10^9$ Ω/cm and the surface roughness Rz is 8 μm. Yellow (Y), cyan (C), magenta (M), and black (K) toners having Dv50 of 8.0 μm are manufactured. The rate in the number-diameter distribution of toner particles having a diameter of not more than ½Dv50 (4 μm) of the above toners is 24.5%. The above-described conditions are applied to a tandem type (single path type) color image forming apparatus having four exposure units 3 and the developing unit 30 as shown in FIG. 5. The effective internal volume of each of the developing unit 30 is 120 $cm^3$, the AD of toner is 0.34 $g/cm^3$ for Y toner, 0.37 $g/cm^3$ for M toner, 0.33 $g/cm^3$ for C toner, and 0.39 $g/cm^3$ for K toner. A reliability test was performed by performing print with a 5% coverage. The residual quantity of toner in the development cartridge 10 is calculated by counting the number of exposed dots of the exposure unit 3 that is equivalent to the number of pixels. When the residual quantity of toner in the development cartridge 10 reaches 8%, the toner is supplied. According to the present test, a high quality image can not be obtained at the initial stage. Thus, a reliability test has not been performed.

The regulating blade 12 is installed in a trail method. The diameter of the developing roller 11 is 15 mm and the thickness of the elastic rubber layer 11*a* is 1.0 mm. The resistance of the developing roller 11 is $10^9$ Ω/cm and the surface roughness Rz is 8 μm. Yellow (Y), cyan (C), magenta (M), and black (K) toners having Dv50 of 8.0 μm are manufactured. The rate in the number-diameter distribution of toner particles having a diameter of not more than ½Dv50 (4 μm) of the above toners is 23%. The above-described conditions are applied to a tandem type (single path type) color image forming apparatus having four exposure units 3 and the developing unit 30 as shown in FIG. 5. The effective internal volume of each of the developing unit 30 is 120 $cm^3$, the AD of toner is 0.34 $g/cm^3$ for Y toner, 0.37 $g/cm^3$ for M toner, 0.33 $g/cm^3$ for C toner, and 0.39 $g/cm^3$ for K toner. A reliability test was performed by performing print with a 5% coverage. The residual quantity of toner in the development cartridge 10 is calculated by counting the number of exposed dots of the exposure unit 3 that is equivalent to the number of pixels. When the residual quantity of toner in the development cartridge 10 reaches 0.7%, the toner is supplied. According to the present test, a vertical line is generated on the developing roller 11 so that deterioration in the quality of an image is generated before printing 1,000 pages.

As described above, the electrophotographic image forming apparatus, the development method, and the developing roller according to the exemplary embodiments of the present invention have the following advantageous.

First, by regulating the toner diameter distribution, the trail type regulating blade is adopted so that the minimization and life span of the developing unit and the image forming apparatus can be improved.

Second, since the developing unit is divided into the development cartridge and the toner cartridge, the minimization of the image forming apparatus and the reduction of the cost for expendable supplies are possible.

Third, since toner is timely supplied to the development cartridge corresponding to the residual quantity of toner in the development cartridge, the filming of toner on the developing roller and the regulating blade can be prevented.

While exemplary embodiments of the present invention have been particularly shown and described with reference to exemplary embodiments thereof, it will be understood by those skilled in the art that various changes in form and details may be made therein without departing from the spirit and scope of the invention as defined by the appended claims.

What is claimed is:

1. An electrophotographic image forming apparatus, comprising:

an image receptor to form an electrostatic latent image; and a developing unit developing the electrostatic latent image by supplying non-magnetic mono-component toner to the electrostatic latent image, the developing unit including a developing roller facing the image receptor and a trail type regulating blade installed so as to form a uniform toner layer on the developing roller;

wherein the rate of amount of toner particles having a diameter of not more than about half of a median value of a volume-diameter distribution of the toner is not more than about 15% in a number-diameter distribution.

2. The apparatus as claimed in claim 1, wherein an elastic rubber layer having a thickness of not less than about 0.5 mm and not more than about 60% of the radius of the developing roller and a resistance between about $10^5$-$10^{11}$ Ω/cm is provided on a surface of the developing roller.

3. The apparatus as claimed in claim 2, wherein the surface roughness Rz of the developing roller is about 1/10 through 5 times greater than a median value of the volume-diameter distribution of the toner.

4. The apparatus as claimed in claim 3, wherein the developing roller separates from the image receptor a distance as wide as a development gap.

5. The apparatus as claimed in claim 1, wherein the developing unit comprises:

a development cartridge including the developing roller and the regulating blade; and a toner cartridge containing toner to supply to the development cartridge.

6. The apparatus as claimed in claim 5, wherein the toner is supplied from the toner cartridge to the development cartridge before the residual quantity of toner in the development cartridge reaches not more than about 1 weight percent of the maximum toner capability of the development cartridge.

7. The apparatus as claimed in claim 6, wherein an elastic rubber layer having a thickness of not less than about 0.5 mm and not more than about 60% of the radius of the developing roller and a resistance between about $10^5$-$10^{11}$ Ω/cm is provided on a surface of the developing roller.

8. The apparatus as claimed in claim 7, wherein the surface roughness Rz of the developing roller is about 1/10 through 5 times greater than a median value of the volume-diameter distribution of the toner.

9. The apparatus as claimed in claim 8, wherein the developing roller separates from the image receptor a distance as wide as a development gap.

10. A developing method using non-magnetic mono-component toner, the developing method comprising:

supplying non-magnetic mono-component toner in which the rate of amount of toner particles having a diameter of not more than about half of a median value of a volume-diameter distribution is not more than about 15% in a number-diameter distribution, to a developing roller;

forming a uniform toner layer on the developing roller using a trail type regulating blade; and applying a development bias to the developing roller to develop an electrostatic latent image formed on an image receptor using the toner of the toner layer.

11. The developing method as claimed in claim 10, wherein the toner is supplied from a toner cartridge to a development cartridge before the residual quantity of toner in the development cartridge reaches not more than about 1 weight percent of a maximum toner capability of the development cartridge.

* * * * *